US012565746B2

(12) United States Patent
Szczerba et al.

(10) Patent No.: US 12,565,746 B2
(45) Date of Patent: Mar. 3, 2026

(54) MOBILE SPREAD-OUT SEPARATING AND PROTECTING BARRIER

(71) Applicant: Marcin Szczerba, Człuchów (PL)

(72) Inventors: Marcin Szczerba, Człuchów (PL); Tomasz Budek, Płońsk (PL)

(73) Assignee: Marcin Szczerba, Czluchow (PL)

( * ) Notice: Subject to any disclaimer, the term of this patent is extended or adjusted under 35 U.S.C. 154(b) by 814 days.

(21) Appl. No.: 17/618,458

(22) PCT Filed: May 13, 2020

(86) PCT No.: PCT/PL2020/050039

§ 371 (c)(1),
(2) Date: Dec. 11, 2021

(87) PCT Pub. No.: WO2020/231281

PCT Pub. Date: Nov. 19, 2020

(65) Prior Publication Data

US 2022/0307209 A1 Sep. 29, 2022

(30) Foreign Application Priority Data

May 13, 2019 (PL) ..... 429914

(51) Int. Cl.
*E01F 13/02* (2006.01)

(52) U.S. Cl.
CPC ..... *E01F 13/022* (2013.01)

(58) Field of Classification Search
CPC ..... E01F 9/654; E01F 9/688; E01F 13/022
USPC ..... 116/63 P, 63 T
See application file for complete search history.

(56) References Cited

U.S. PATENT DOCUMENTS 3,457,684 A * 7/1969 Wood, Jr. ..... E04H 15/20 52/2.21
3,690,620 A * 9/1972 Matson ..... E01F 9/688 256/64
4,186,912 A 2/1980 Byrd, Jr.
4,253,260 A * 3/1981 Maza ..... G09F 15/0062 116/63 P
4,279,105 A * 7/1981 Cameron ..... F16M 11/10 116/63 T
4,977,697 A * 12/1990 Genick ..... E01F 9/688 40/539
5,225,254 A * 7/1993 Foulke ..... E01F 9/688 229/116

(Continued)

FOREIGN PATENT DOCUMENTS

BE 1017450 10/2008
DE 3243842 A * 5/1984 ..... A63K 3/046

(Continued)

OTHER PUBLICATIONS

U.S. Appl. No. 60/362,449, filed Mar. 14, 2000, William Kuntz.

(Continued)

*Primary Examiner* — Gary S Hartmann
(74) *Attorney, Agent, or Firm* — Andrzej Malarz, Esq.

(57) ABSTRACT

A mobile spread-out separating and protecting barrier consisting of air-filled side walls and a base, characterized in that at least two side walls (1) are hinged together in the upper part and connected with at least one plane that constitutes the base (2), wherein the side walls (1) preferably have at least one hole (3)

10 Claims, 3 Drawing Sheets

(56) References Cited

Figure 2:
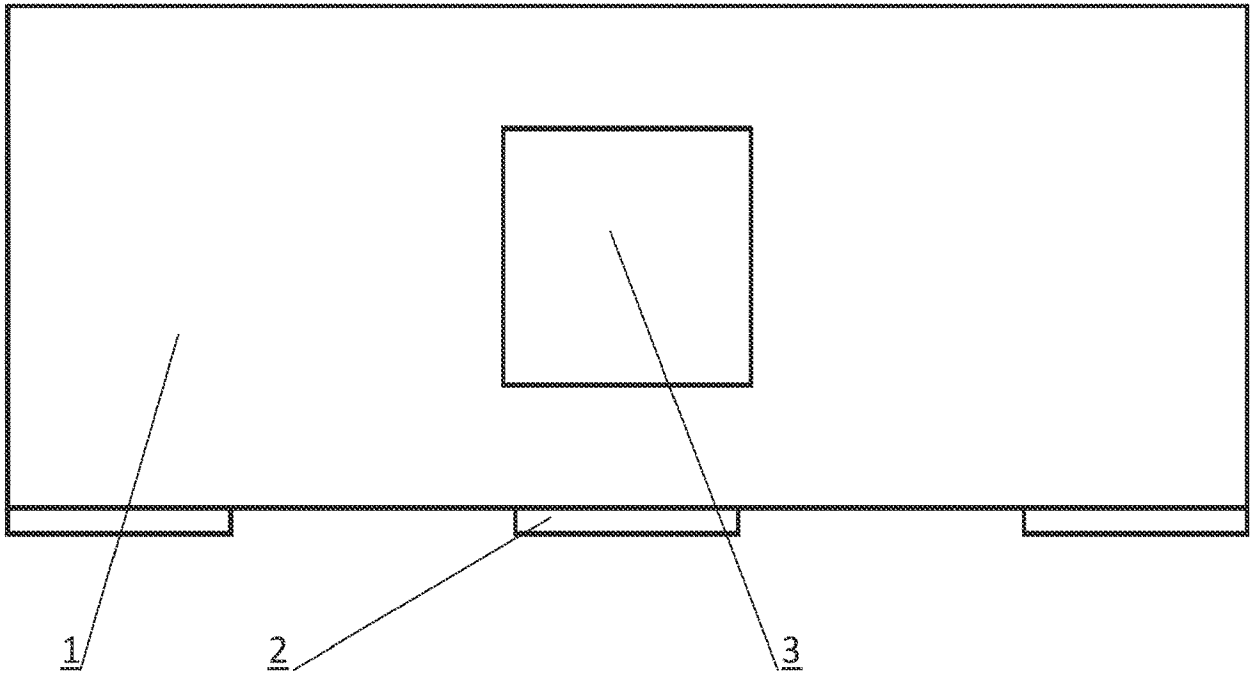

U.S. PATENT DOCUMENTS 6,008,938 A * 12/1999 Suehle ..... E01F 9/654 359/443
6,036,249 A 3/2000 Kuntz
6,102,568 A * 8/2000 Davis ..... B65D 33/02 229/117.34
6,435,762 B1 * 8/2002 Markling ..... E01F 9/688 404/6
6,507,287 B1 * 1/2003 Barnett ..... E01F 9/688 116/63 P
7,181,877 B2 * 2/2007 Quade ..... E04H 15/20 52/2.21
7,325,345 B2 * 2/2008 Hailo ..... G09F 15/0056 116/63 P
7,690,321 B2 * 4/2010 Karow ..... E01F 9/654 116/63 P
7,789,585 B2 * 9/2010 Christensen ..... E01F 13/022 116/63 P
8,256,369 B2 * 9/2012 Karow ..... E01F 13/02 116/63 P
8,256,985 B2 * 9/2012 Ashmead ..... E01F 13/02 404/6
9,260,829 B1 * 2/2016 Maus ..... E01F 13/022
9,702,099 B2 * 7/2017 Rust ..... G09F 23/00
11,605,317 B2 * 3/2023 Owen ..... G09F 15/0062
11,790,813 B2 * 10/2023 Struhl ..... G09F 15/0018 40/606.02
2010/0202828 A1 8/2010 Ashmead
2013/0008064 A1 1/2013 Park
2017/0167091 A1 6/2017 Allison

FOREIGN PATENT DOCUMENTS

FR 2928667 A1 9/2009
PL 67569 Y1 1/2015

OTHER PUBLICATIONS

International Search Report, mailed on Aug. 19, 2020, issued in the corresponding international patent application No. PCT/PL2020/050039.

* cited by examiner

MOBILE SPREAD-OUT SEPARATING AND PROTECTING BARRIER

CROSS REFERENCE TO RELATED APPLICATIONS

The present application is a U.S. National Phase of International Patent Application PCT/PL2020/050039, filed on May 13, 2020, claiming a priority of Polish patent application No.: P.429914, filed May 13, 2019, the content of each of which is incorporated by reference in its entirety for all purpose.

FIELD OF INVENTION

The subject matter of the invention is a mobile spread-out separating and protecting barrier designed to protect the sites of accidents and breakdowns, to separate fire brigade access routes, outdoor events, to protect against adverse weather conditions, and/or to serve advertising purposes.

BACKGROUND

It is known from the description of the invention US20130008064 an inflatable signboard capable of easily coupling. An inflatable signboard capable of easily coupling an inflatable pillar includes a support which is put on the ground and a coupling bar which is a coupling medium positioned between the support and an inflatable pillar erected on the upper part of the support, wherein a pillar insertion groove into which the inflatable pillar is capable of being inserted is formed on an upper surface of the coupling bar, a gap of the pillar insertion groove is filled with a wooden lath, and the coupling bar, the wooden lath, and the inflatable pillar are penetrated and fixed simultaneously through a plurality of fixing pieces, thereby coupling the inflatable pillar easily.

It is known from the description of the invention number BE1017450 controls and a communication module including for controlling the height of the so-called sky-tubes, which are tubes through which air is blown in order to inflate them so that they adopt a vertical position. The base unit houses an energy source for at least one fan located inside a compartment which in turn is located beneath another compartment connected to at least one sky-tube. A grate is located between the two compartments.

It is known from the description of the invention number US4186912 an accident screen kit comprising an elongated fabric screen of light-reflective material, preferably of alternating stripes. The material is in the form of an elongated strip which is supported at each end by a folding post of a light weight tubular plastic material. The posts are each provided with mounting cables for supporting the same in a position obscuring the site of an accident from the view of passing motorists. The fabric is also provided with a plurality of elongated slots which permit passage of air and thus prevent wind damage. The use of this accident screen obscures accident sites and prevents the inevitable slowdown in traffic passing the site of an accident. The accident screen is highly portable and may be handled and erected by one person.

It is known from the description of the invention number U.S. Pat. No. 6,036,249 an accident shield device. The present invention is a low cost, easy to operate, and ever handy device of blocking views of accidents, stalled cars or other incidents. This is accomplished by an accident shield device unit installed in the trunk of official vehicles which can be assembled by a single person in a few minutes. The unit consists of a screen which is large enough to prevent most passersby (motorists or pedestrians) from viewing the scene. As a result, this device aids in maintaining traffic flow and safety by preserving the natural momentum of traffic and keeping other drivers focused on traffic conditions, rather than the accident scene or stalled vehicle.

It is known from the description of the invention number US2017167091 a portable traffic incident screen. A portable free-standing traffic incident screening assembly of flexible fabric (tarp, screen, etc.) stretched between at least two stanchions, each stanchion having at least three adjustable legs, flexible telescoping vertical extension portions, and removable ballast. The portable screens defend incident sites by establishing privacy, reduce the probability of secondary accidents due to an unprotected scene, and provide a secure environment for incident investigators.

SUMMARY

The essence of the invention is the mobile spread-out separating and protecting barrier, which consists of air-filled side walls and a base, and which is characterized in that at least two side walls are hinged together in the upper part and connected with at least one plane that constitutes the base, wherein the side walls preferably have at least one hole. Preferably, the surface area of the hole in the side walls is 10% to 85% of the side walls' total surface area.

Preferably, the angle between the side walls is 15° to 90°.

Preferably, the side walls are hinged together with the base at both connecting edges.

Preferably, the base consists of three transverse planes.

Preferably, the three transverse planes of the base make up 10% to 94% of its total surface area.

Preferably, the opposing walls have a hole that is positioned opposite itself.

Preferably, the opposing walls have a hole that is offset in relation to itself.

Preferably, one side wall has one hole and the other side wall has two holes located in different places in relation to each other.

Preferably, the side walls have two symmetrical holes.

Preferably, the side walls are hinged together with the base at both connecting edges.

Preferably, the height of the triangle formed by the side walls is greater than the width of the plane of the base.

Preferably, each side wall and the base have a filling valve.

Preferably, a side wall and the base have a shared filling valve that is connected to the individual side walls and to the planes of the base via a distributor.

Preferably, the side walls and the base are made of two layers of woven polyester fabric coated with synthetic polymers.

The invention allows to obtain a stable mobile spread-out separating and protecting barrier. As a result of the hinged connection of the side walls and the plane of the floor, after inflation the walls and the floor become interlocked, which results in obtaining a structure that is is able to maintain the set, designed shape regardless of weather conditions. The applied holes in the walls allow to achieve a lower weight of the whole structure, and reduce the space to be inflated, which reduces the surface area of the structure that is affected by external forces, thus increasing its resistance to adverse weather conditions.

Also the application of a divided plane of the base of the invention allows to reduce the weight of the structure, reduce its volume, and obtain space needed to attach ballasts that stabilize the structure and hold the structure in place.

With regard to gusts of wind, the angular inclination of the barrier's walls applied in the invention allows to reduce the force with which the wind acts on it, which translates into the structure's increased resistance to weather conditions.

The open space—i.e. no walls that would close the structure between the walls inclined toward each other—allows free flow of air inside/along the barrier, which increases its resistance to weather conditions too.

The application of drop-stitch material in the barrier, which material takes the form of a module after being inflated to the set pressure, and which material has a relatively rigid structure with the set shape and is able to maintain this shape over time, in adverse weather conditions. The barrier made of drop-stitch material can withstand high loads and deflections (deviations from the original shape). What is more, the application of material that becomes hard after inflation allows to fit the structure with additional equipment-mounting points and to achieve additional functions, e.g. lighting, or magnetic boards for holding tools.

BRIEF DESCRIPTION OF SEVERAL VIEWS OF DRAWINGS

The subject matter of the invention is shown in the drawing, where

Figure 1:
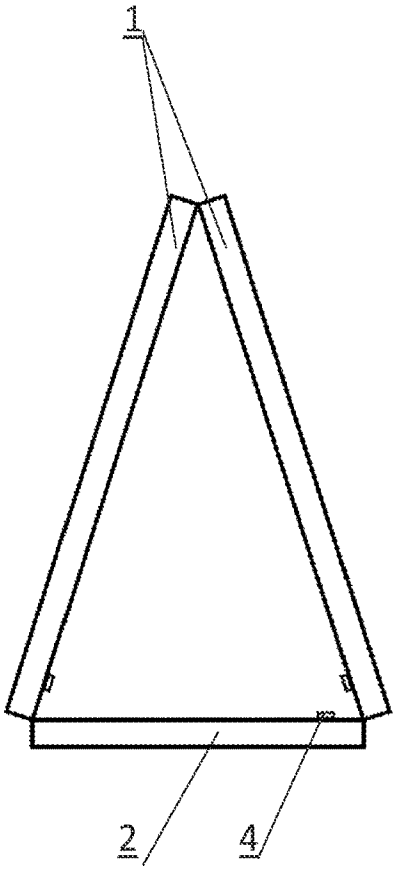
Figure 4:
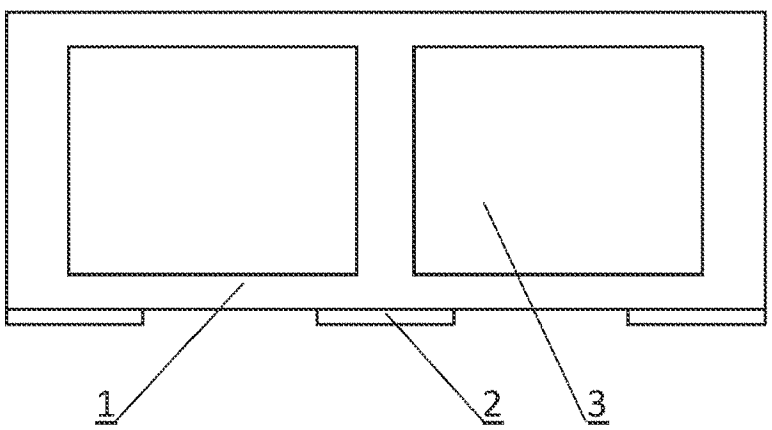
Figure 3:
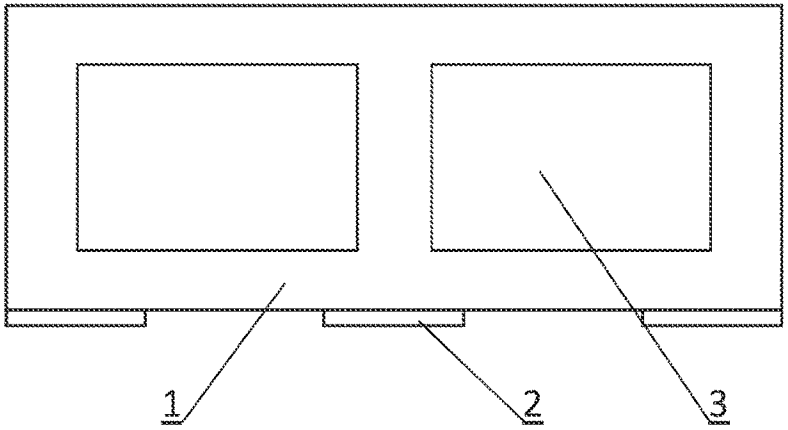
Figure 5:
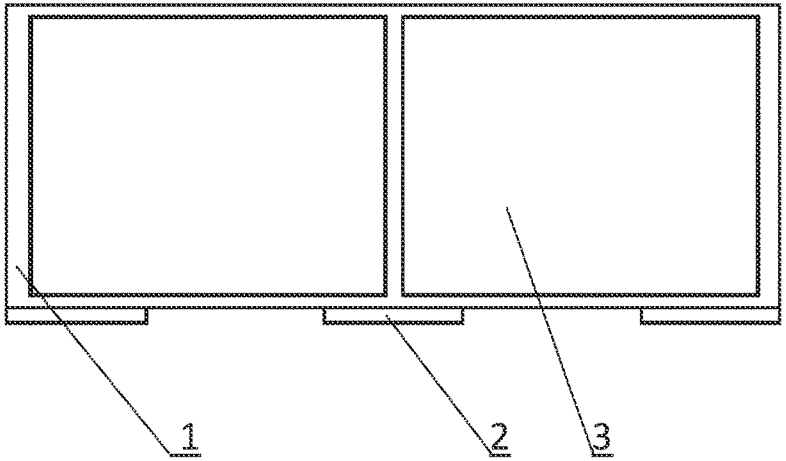
Figure 6:
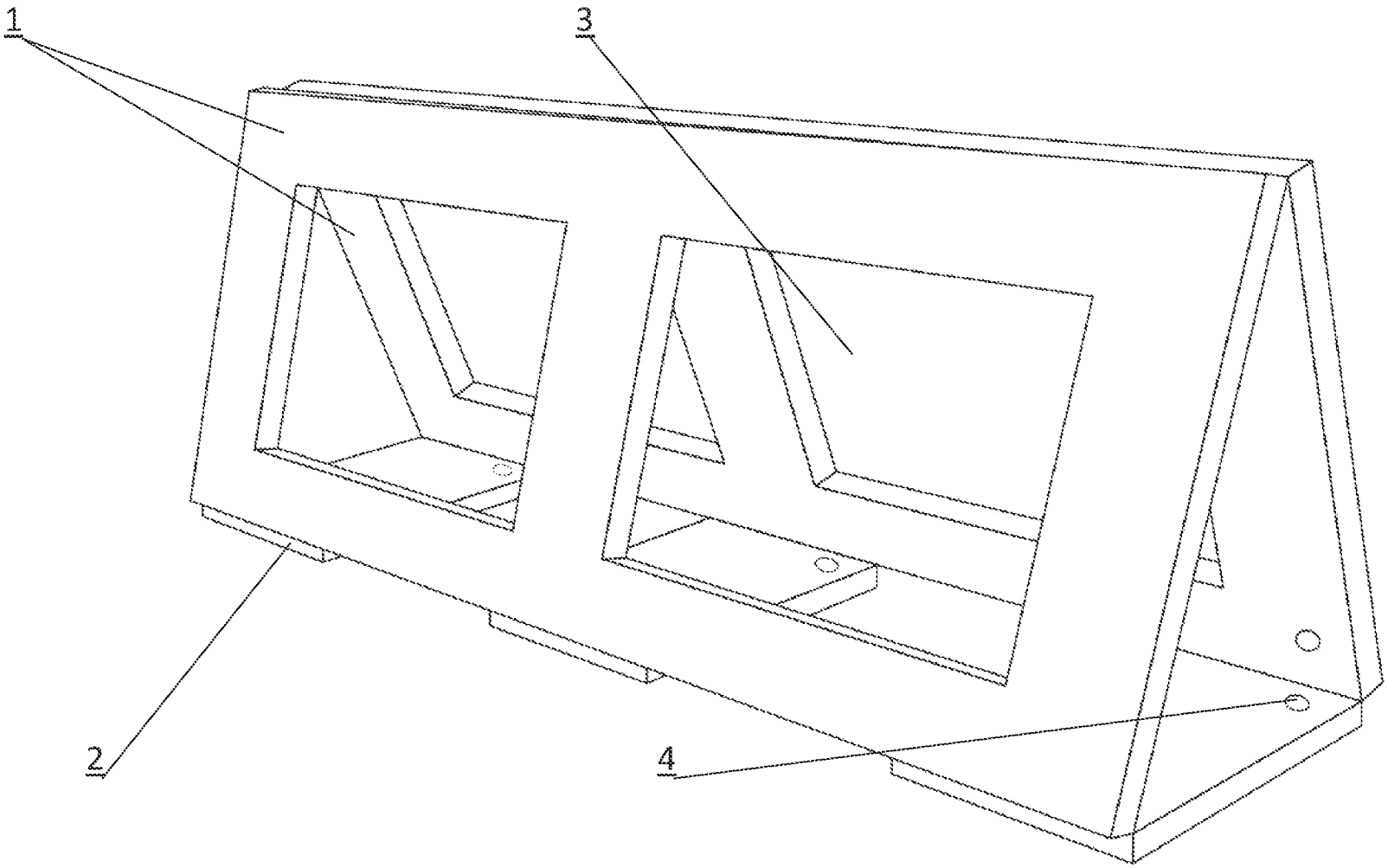

FIG. 1 presents the mobile spread-out separating and protecting barrier viewed from the side, FIG. 2 presents the mobile spread-out separating and protecting barrier viewed from the front, FIG. 3 presents the mobile spread-out separating and protecting barrier viewed from the front, where the surface area of the hole in the side walls is 43% of their total surface area, FIG. 4 presents the mobile spread-out separating and protecting barrier viewed from the front, where the surface area of the hole in the side walls is 57% of their total surface area, FIG. 5 presents the mobile spread-out separating and protecting barrier viewed from the front, where the surface area of the hole in the side walls is 83% of their total surface area, and FIG. 6 presents the mobile spread-out separating and protecting barrier in an axonometric view.

DETAILED DESCRIPTION

EMBODIMENT I

In the embodiment, the mobile spread-out separating and protecting barrier consists of the air-filled side walls and base. The two side walls 1 are hinged together in the upper part and connected to one plane that constitutes the base 2, wherein the side walls 1 have one hole 3. Each side wall 1 and the base 2 have a filling valve 4. The side walls 1 and the base 2 are made using the drop-stitch technique, i.e. two layers of woven polyester fabric coated with synthetic polymers.

EMBODIMENT II

In the embodiment, the mobile spread-out separating and protecting barrier consists of the air-filled side walls and base. The two side walls 1 are hinged together in the upper part and connected to one plane that constitutes the base 2, wherein the side walls 1 have one hole 3 that is positioned opposite itself. The surface area of the hole 3 in the side walls 1 is 10% of their total surface area. The angle between the side walls 1 is 15°. Each side wall 1 and the base 2 have a filling valve 4. The side walls 1 and the base 2 are made using the drop-stitch technique, i.e. two layers of woven polyester fabric coated with synthetic polymers.

EMBODIMENT III

In the embodiment, the mobile spread-out separating and protecting barrier consists of the air-filled side walls and base. The two side walls 1 are hinged together in the upper part and connected to one plane that constitutes the base 2, wherein the side walls 1 have one hole 3 that is offset in relation to itself. The surface area of the hole 3 in the side walls 1 is 83% of their total surface area. The angle between the side walls 1 is 90°. The side walls 1 are hinged together with the base 2 at both connecting edges. Each side wall 1 and the base 2 have a filling valve 4. The side walls 1 and the base 2 are made using the drop-stitch technique, i.e. two layers of woven polyester fabric coated with synthetic polymers.

EMBODIMENT IV

In the embodiment, the mobile spread-out separating and protecting barrier consists of the air-filled side walls and base. The two side walls 1 are hinged together in the upper part and connected to one plane that constitutes the base 2, wherein the side walls 1 have two symmetrical holes 3 positioned opposite themselves. The surface area of the hole in the side walls 1 is 60% of their total surface area. The angle between the side walls 1 is 80°. The side walls 1 are hinged together with the base 2 at both connecting edges. The side walls 1 and the base 2 have a shared filling valve 4 that is connected, via a distributor, to the individual side walls 1 and the plane of the base 2. The side walls 1 and the base 2 are made using the drop-stitch technique, i.e. two layers of woven polyester fabric coated with synthetic polymers.

EMBODIMENT V

In the embodiment, the mobile spread-out separating and protecting barrier consists of the air-filled side walls and base. The two side walls 1 are hinged together in the upper part and connected to one plane that constitutes the base 2, wherein the side walls 1 have two holes 3 that are offset in relation to themselves. The surface area of the hole in the side walls 1 is 30% of their total surface area. The angle between the side walls 1 is 36°. Each side wall 1 and the base 2 have a filling valve 4. The side walls 1 and the base 2 are made using the drop-stitch technique, i.e. two layers of woven polyester fabric coated with synthetic polymers.

EMBODIMENT VI

In the embodiment, the mobile spread-out separating and protecting barrier consists of the air-filled side walls and base. The two side walls 1 are hinged together in the upper part and connected to two planes that constitute the base 2, wherein the side walls 1 have three symmetrical holes 3 positioned opposite themselves. The surface area of the hole in the side walls 1 is 85% of their total surface area. The angle between the side walls 1 is 60°. The side walls 1 are hinged together with the base 2 at both connecting edges.

The side walls 1 and the base 2 have a shared filling valve 4 that is connected, via a distributor, to the individual side walls 1 and the planes of the base 2. The side walls 1 and the base 2 are made using the drop-stitch technique, i.e. two layers of woven polyester fabric coated with synthetic polymers.

EMBODIMENT VII

In the embodiment, the mobile spread-out separating and protecting barrier consists of the air-filled side walls and base. The two side walls 1 are hinged together in the upper part and connected to three transverse planes that constitute the base 2, wherein the side walls 1 have two symmetrical holes 3 positioned opposite themselves. The surface area of the hole in the side walls 1 is 43% of their total surface area. The angle between the side walls 1 is 36°. The side walls 1 are hinged together with the base 2 at both connecting edges. The three transverse planes of the base 2 make up 46% of its total surface area. Each side wall 1 and the base 2 have a filling valve 4. The side walls 1 and the base 2 are made using the drop-stitch technique, i.e. two layers of woven polyester fabric coated with synthetic polymers.

EMBODIMENT VIII

In the embodiment, the mobile spread-out separating and protecting barrier consists of the air-filled side walls and base. The two side walls 1 are hinged together in the upper part and connected to three transverse planes that constitute the base 2, wherein the side walls 1 have two symmetrical holes 3 positioned opposite themselves. The surface area of the hole in the side walls 1 is 55% of their total surface area. The angle between the side walls 1 is 35°. The side walls 1 are hinged together with the base 2 at both connecting edges. The three transverse planes of the base 2 make up 30% of its total surface area. Each side wall 1 and the base 2 have a filling valve 4. The side walls 1 and the base 2 are made using the drop-stitch technique, i.e. two layers of woven polyester fabric coated with synthetic polymers.

EMBODIMENT IX

In the embodiment, the mobile spread-out separating and protecting barrier consists of the air-filled side walls and base. The two side walls 1 are hinged together in the upper part and connected to three transverse planes that constitute the base 2, wherein the side walls 1 have two symmetrical holes 3 positioned opposite themselves. The surface area of the hole in the side walls 1 is 60% of their total surface area. The angle between the side walls 1 is 36°. The side walls 1 are hinged together with the base 2 at both connecting edges. The three transverse planes of the base 2 make up 35% of its total surface area. Each side wall 1 and the base 2 have a filling valve 4. The side walls 1 and the base 2 are made using the drop-stitch technique, i.e. two layers of woven polyester fabric coated with synthetic polymers.

EMBODIMENT X

In the embodiment, the mobile spread-out separating and protecting barrier consists of the air-filled side walls and base. The two side walls 1 are hinged together in the upper part and connected to three transverse planes that constitute the base 2, wherein the side walls 1 have two symmetrical holes 3 positioned opposite themselves. The surface area of the hole in the side walls 1 is 43% of their total surface area. The angle between the side walls 1 is 36°. The side walls 1 are hinged together with the base 2 at both connecting edges. The three transverse planes of the base 2 make up 46% of its total surface area. The height of the triangle formed by the side walls 1 is greater than the width of the plane of the base 2. Each side wall 1 and the base 2 have a filling valve 4. The side walls 1 and the base 2 are made using the drop-stitch technique, i.e. two layers of woven polyester fabric coated with synthetic polymers.

EMBODIMENT XI

In the embodiment, the mobile spread-out separating and protecting barrier consists of the air-filled side walls and base. The two side walls 1 are hinged together in the upper part and connected to three transverse planes that constitute the base 2, wherein the side walls 1 have two symmetrical holes 3 that are offset in relation to themselves. The surface area of the hole in the side walls 1 is 57% of their total surface area. The angle between the side walls 1 is 80°. The side walls 1 are hinged together with the base 2 at both connecting edges. The three transverse planes of the base 2 make up 58% of its total surface area. The height of the triangle formed by the side walls 1 is greater than the width of the plane of the base 2. Each side wall 1 and the base 2 have a filling valve 4. The side walls 1 and the base 2 are made using the drop-stitch technique, i.e. two layers of woven polyester fabric coated with synthetic polymers.

EMBODIMENT XII

In the embodiment, the mobile spread-out separating and protecting barrier consists of the air-filled side walls and base. The two side walls 1 are hinged together in the upper part and connected to three transverse planes that constitute the base 2, wherein the side walls 1 have two holes 3 positioned opposite themselves. The surface area of the hole in the side walls 1 is 2.5% of their total surface area. The angle between the side walls 1 is 40°. The side walls 1 are hinged together with the base 2 at both connecting edges. The three transverse planes of the base 2 make up 1% of its total surface area. The height of the triangle formed by the side walls 1 is greater than the width of the plane of the base 2. Each side wall 1 and the base 2 have a filling valve 4. The side walls 1 and the base 2 are made using the drop-stitch technique, i.e. two layers of woven polyester fabric coated with synthetic polymers.

EMBODIMENT XIII

In the embodiment, the mobile spread-out separating and protecting barrier consists of the air-filled side walls and base. The two side walls 1 are hinged together in the upper part and connected to three transverse planes that constitute the base 2, wherein the side walls 1 have two holes 3 positioned opposite themselves. The surface area of the hole in the side walls 1 is 83% of their total surface area. The angle between the side walls 1 is 90°. The side walls 1 are hinged together with the base 2 at both connecting edges. The three transverse planes of the base 2 make up 94% of its total surface area. The height of the triangle formed by the side walls 1 is greater than the width of the plane of the base 2. Each side wall 1 and the base 2 have a filling valve 4. The side walls 1 and the base 2 are made using the drop-stitch technique, i.e. two layers of woven polyester fabric coated with synthetic polymers.

EMBODIMENT XIV

In the embodiment, the mobile spread-out separating and protecting barrier consists of the air-filled side walls and base. The two side walls 1 are hinged together in the upper part and connected to three transverse planes that constitute the base 2, wherein one side wall 1 has one hole 3, and the other side wall has two holes 3 located in different places in relation to each other. The surface area of the hole in the side walls 1 is 83% of their total surface area. The angle between the side walls 1 is 90°. The side walls 1 are hinged together with the base 2 at both connecting edges. The three transverse planes of the base 2 make up 94% of its total surface area. The height of the triangle formed by the side walls 1 is greater than the width of the plane of the base 2. Each side wall 1 and the base 2 have a filling valve 4. The side walls 1 and the base 2 are made using the drop-stitch technique, i.e. two layers of woven polyester fabric coated with synthetic polymers.

The invention claimed is:

1. A mobile spread-out separating and protecting barrier comprising air-filled side walls and a base, characterized in that at least two side walls (1) are hinged together in an upper part of the barrier, wherein the at least two side walls (1) have at least one hole (3), wherein the at least two side walls (1) are hinged together with the base (2) at connecting edges, and wherein three separate transverse planes of the base (2) make up 10% to 94% of a total surface area of the base (2).

2. The mobile spread-out barrier according to claim 1, characterized in that a surface area of the hole in the at least two side walls (1) is 10% to 85% of a side walls' total surface area.

3. The mobile spread-out barrier according to claim 1, characterized in that an angle between the at least two side walls (1) is 15 to 90°.

4. The mobile spread-out barrier according to claim 1, characterized in that one of the opposing walls (1) have the hole (3) that is positioned opposite to the hole (3) of the other opposing wall (1).

5. The mobile spread-out barrier according to claim 1, characterized in that one of the opposing walls (1) have the hole (3) that is offset in relation to the hole (3) of the other opposing wall (1).

6. The mobile spread-out barrier according to claim 1, characterized in that one side wall (1) has one hole (3) and the other side wall (1) has two holes (3) that are offset in relation to the one hole (3) of the one side wall (1).

7. The mobile spread-out barrier according to claim 1, characterized in that each of the at least two side walls (1) has two symmetrical holes.

8. The mobile spread-out barrier according to claim 1, characterized in that a height of the triangle formed by the at least two side walls (1) is greater than a width of the plane of the base (2).

9. The mobile spread-out barrier according to claim 1, characterized in that each side wall (1) and the base (2) have a filing valve (4).

10. The mobile spread-out barrier according to claim 1, characterized in that the side wall (1) and the base (2) have a shared filling valve (4) that is connected, via a distributor, to the individual at least two side walls (1) and the planes of the base (2).

* * * * *